US008517480B2

(12) United States Patent
Kose et al.

(10) Patent No.: US 8,517,480 B2
(45) Date of Patent: Aug. 27, 2013

(54) HANDLE FOR A HOUSEHOLD APPLIANCE

(75) Inventors: Ertugrul Kose, Istanbul (TR); Tugrul Basesme, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 203 days.

(21) Appl. No.: 12/667,532

(22) PCT Filed: Jul. 2, 2008

(86) PCT No.: PCT/EP2008/058514
§ 371 (c)(1),
(2), (4) Date: Jun. 14, 2010

(87) PCT Pub. No.: WO2009/004030
PCT Pub. Date: Jan. 8, 2009

(65) Prior Publication Data

US 2011/0050062 A1 Mar. 3, 2011

(30) Foreign Application Priority Data

Jul. 4, 2007 (TR) ..... a 2007 04678

(51) Int. Cl.
*A47B 49/00* (2006.01)
*A47B 95/02* (2006.01)

(52) U.S. Cl.
USPC ..... 312/326; 312/228; 312/348.6

(58) Field of Classification Search
USPC ..... 312/228, 326–329, 348.6, 332.1, 312/244; 16/408; 411/511–530
See application file for complete search history.

(56) References Cited

U.S. PATENT DOCUMENTS

| | | | | | |
|---|---|---|---|---|---|
| 2,001,666 | A * | 5/1935 | Keil | 16/444 |
| 2,157,251 | A * | 5/1939 | Tinnerman | 16/436 |
| 2,239,798 | A * | 4/1941 | Tinnerman | 16/422 |
| 2,498,139 | A * | 2/1950 | Simjian | 248/467 |
| 3,017,657 | A * | 1/1962 | Mills | 16/413 |
| 3,406,431 | A * | 10/1968 | Armstrong et al. | 24/607 |
| 3,471,186 | A * | 10/1969 | Geen et al. | 403/197 |
| 4,404,709 | A * | 9/1983 | Janz et al. | 16/444 |
| 4,733,987 | A * | 3/1988 | Tomlinson et al. | 403/326 |
| 4,801,106 | A * | 1/1989 | Kawakami et al. | 242/159 |
| 4,827,567 | A * | 5/1989 | Beach | 16/422 |
| 5,131,785 | A * | 7/1992 | Shimazaki | 403/326 |
| 6,481,701 | B2 * | 11/2002 | Kessen et al. | 267/166 |
| 6,789,294 | B2 * | 9/2004 | Panek et al. | 16/409 |
| 7,278,693 | B2 * | 10/2007 | Smith et al. | 301/113 |
| 7,357,467 | B2 * | 4/2008 | Lee | 312/328 |
| 7,568,855 | B2 * | 8/2009 | Fitzler et al. | 403/315 |
| 7,640,630 | B2 * | 1/2010 | Lee | 16/413 |
| 2002/0138948 | A1 * | 10/2002 | Jen | 16/408 |
| 2003/0126721 | A1 * | 7/2003 | Panek et al. | 16/409 |
| 2004/0201337 | A1 * | 10/2004 | Wuestefeld et al. | 312/311 |

FOREIGN PATENT DOCUMENTS

| | | | |
|---|---|---|---|
| GB | 498821 | A | 1/1939 |
| GB | 2148108 | * | 5/1985 |
| WO | 2005001351 | A | 1/2005 |
| WO | 2005084517 | A | 9/2005 |

* cited by examiner

*Primary Examiner* — Janet M Wilkens
*Assistant Examiner* — Timothy M Ayres
(74) *Attorney, Agent, or Firm* — Venable, Campillo, Logan & Meaney PC

(57) ABSTRACT

The present invention relates to a household appliance (1) comprising a door (2) allowing access of the user inside, an outer panel (8) forming the surface of the door (2) in contact with the outside, preferably produced of a thin material like steel sheet, a handle (3) mounted on the outer panel (8), so that the user can hold to open, close the door (2) and one or more holes (9) on the outer panel (8), in the section wherein the handle (3) is to be mounted.

6 Claims, 3 Drawing Sheets

HANDLE FOR A HOUSEHOLD APPLIANCE

Figure 1:
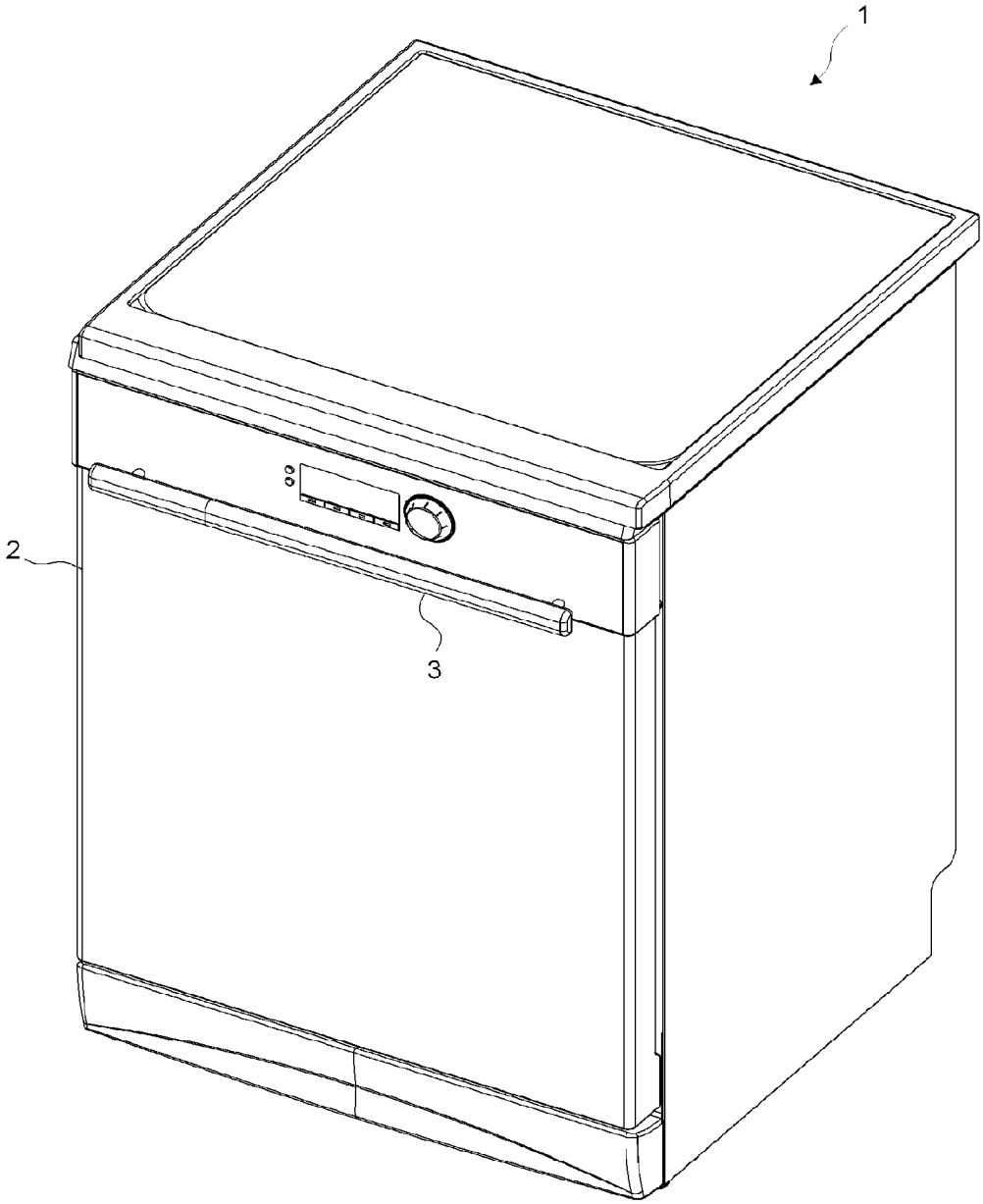

The present invention relates to a household appliance comprising a handle that can be easily mounted on the door.

A handle having an esthetic and ergonomic configuration is utilized by the user for easily opening, closing the doors of household appliances particularly like dishwashers, ovens and refrigerators. All the handles generally form a protrusion on the door projecting outwards from the appliance.

The handle, constituting the part of the appliance that can be damaged by external factors, is mounted to the door during production. Various packaging and transportation techniques are developed for preventing damage of the handles that project from the appliance during the transportation of the appliance.

In the state of the art Great Britain Patent No GB498821 the handle is detached and after transportation is mounted in place rapidly and easily. Thus, the packaging process is made easier and the handle is prevented from damage. In this embodiment, an additional intermediary element is used that prevents the movement of the handle and the head at the end of the handle placed in the sockets from being dislocated after inserting into the socket. In this type of assemblies made without using screws, the intermediary element used to eliminate the assembly gap, should stand rigid in the socket and not move during and after the assembly. Therefore the depth of the socket wherein the intermediary element is seated is greater than the length of the intermediary element. However, such an intermediary element cannot be mounted since it is not possible to form such a socket on a panel made of steel sheets with a thin wall thickness. Accordingly, such an embodiment cannot be used for mounting a handle on a door having an outer panel made of thin metal sheet.

The present invention that is explicated below in detail is fulfilled in order to overcome these kinds of problems encountered in embodiments without using screws.

The aim of the present invention is the realization of a household appliance comprising a handle that can be easily mounted on the door.

The handle of the household appliance realized in order to attain the aim of the present invention, explicated in the first claim and the respective claims thereof, is attached to the outer panel by a pin that bears against the outer panel while mounting the handle. At the end of the pin, a step whereon the outer panel is seated, a groove with a smaller diameter than the step and a head are provided. On the outer panel, a head through which the head passes and two wires partially covering the hole are disposed parallel to each other and having an opening therebetween such that the head can pass through, and which are seated in the groove after the head passes.

While the step prevents the handle mounted on the outer panel from moving in the vertical plane, whereas the groove and the wires seated in the groove take up the assembly gap between the outer panel and the handle thereby preventing the handle from moving both in the vertical and horizontal planes. Moreover, the groove and the wires maintain the handle to be locked on the outer panel. By means of the present invention, the handle is mounted on the outer panel, produced of a thin material such as steel sheet or glass, without using any intermediary elements.

In another embodiment of the present invention, the wires have different diameters from each other. This provides the wires to stretch at different rates. Accordingly, the wire with the smaller diameter stretches more than the other while the head passes through the hole and allows the head to pass through the hole to the backside of the outer panel. The wire with a greater diameter is seated entirely in the groove and thus takes up the assembly gap formed while mounting the handle on the outer panel and prevents the handle from moving on the outer panel.

Consequently, the handle is mounted easily on the door, not during the manufacturing phase but at the final destination of the appliance by the user or the service personnel. This minimizes the possibility of damage to the outwards protruding handle during transportation for delivery of the household appliance to the end user. Moreover, packaging costs are also reduced.

By means of the present invention, the mounting of the handle on the door is made at home by the service personnel or the end user in order to reduce damages while delivering the household appliance to the end user. This type of assembly convenience allows even the consumer to mount the handle on the door without causing any defects.

The handle of the present invention, after mounted on the door once, is not dislodged from place and in cases requiring detachment, can only be intervened by the service personnel. Since there aren't any fastening elements like screws, both workmanship and costs savings are maintained. On the other hand, mounting without screws can be made on a thin panel without using any backfill material.

The household appliance realized in order to attain the aim of the present invention is illustrated in the attached figures, where:

FIG. 1—is the perspective view of a household appliance.

Figure 2:
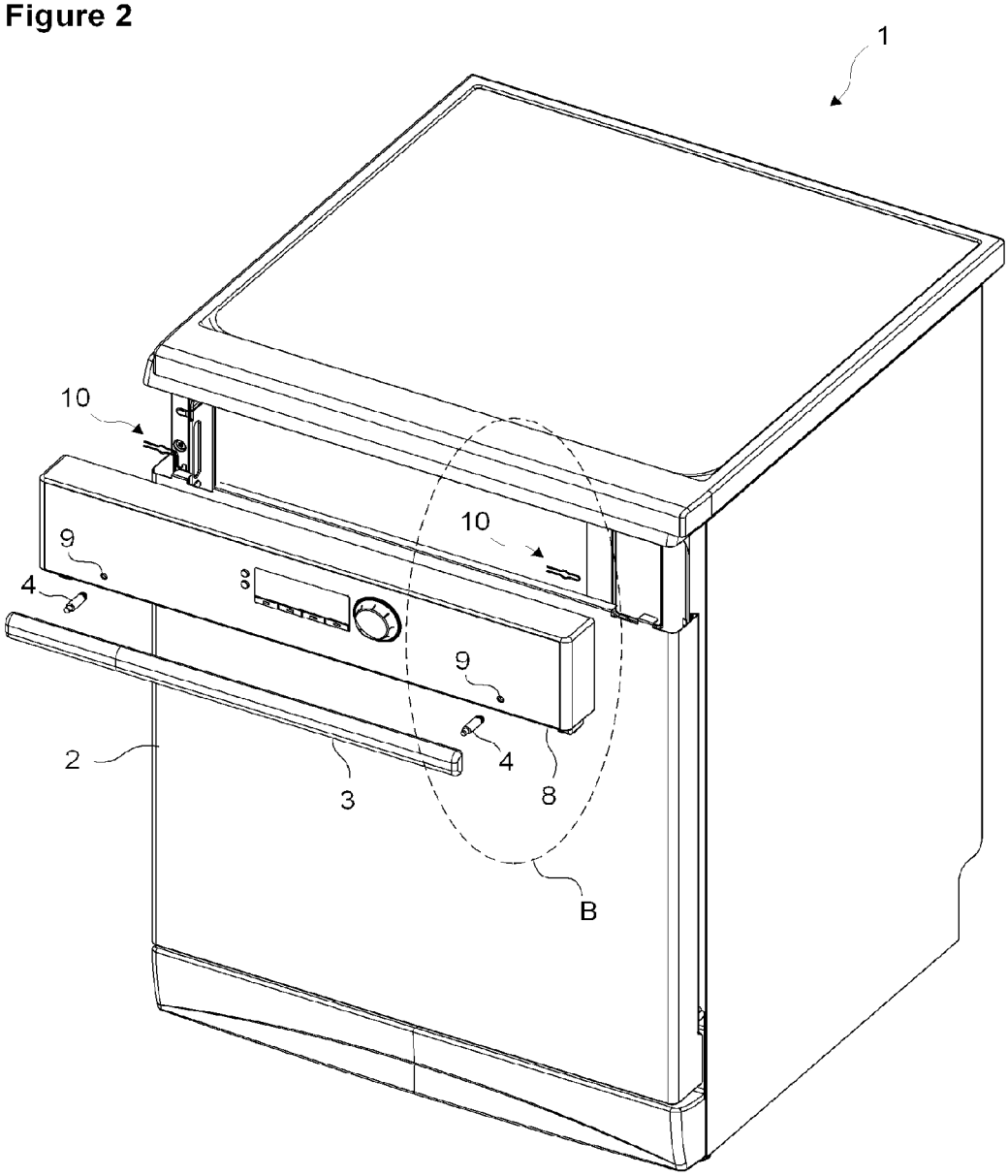

FIG. 2—is the exploded perspective view of a handle and a door.

Figure 3:
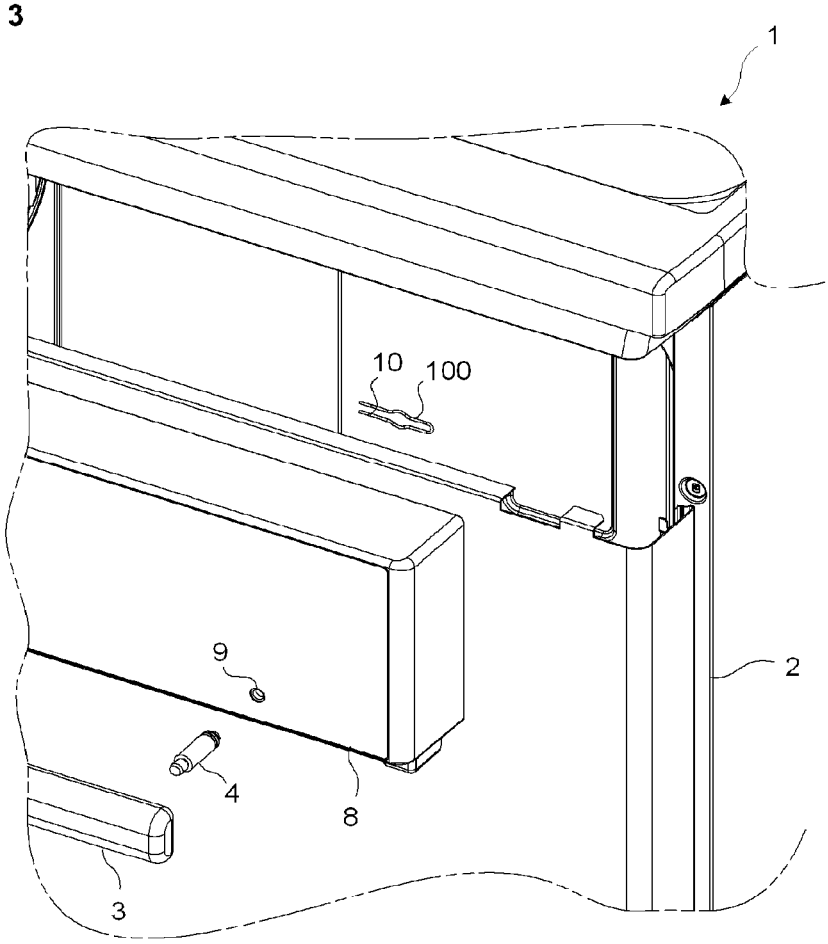

FIG. 3—is the view of detail B in FIG. 2.

Figure 4:
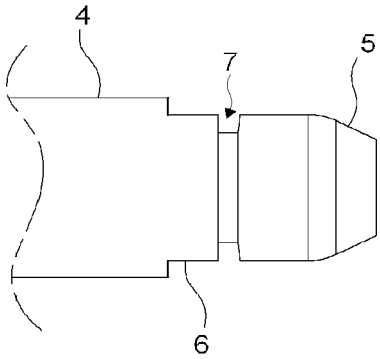

FIG. 4—is the schematic view of the handle.

Figure 5:
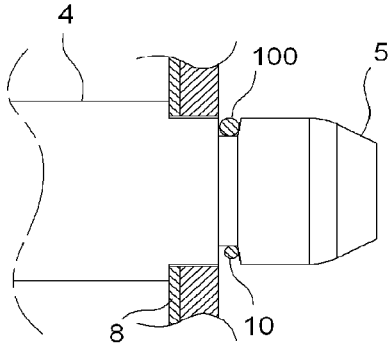

FIG. 5—is the schematic view of the handle mounted on the outer panel.

The elements illustrated in the figures are numbered as follows:

1. Household appliance
2. Door
3. Handle
4. Pin
5. Head
6. Step
7. Groove
8. Outer panel
9. Hole
10. 100. Wire The household appliance (1) of the present invention comprises a door (2) allowing access of the user inside, an outer panel (8) disposed on the door (2) preferably produced of a thin material like steel sheet or glass, a handle (3) mounted on the outer panel (8), so that the user can hold to open, close the door (2) and one or more holes (9) situated on the outer panel (8), in the section wherein the handle (3) is to be mounted (FIG. 1 and FIG. 2).

The household appliance (1) comprises a pin (4) with a diameter greater than the diameter of the hole (9), one end secured on the handle (3), a step (6) on the end of the pin (4) with a diameter virtually the same as the diameter of the hole (9), whereon the outer panel (8) is seated and a groove (7) situated at the end of the step (6) with a diameter smaller than the diameter of the step (6) and a head (5) disposed at the end of the groove (7) that passes to the other side of the outer panel (8) by stretching while the handle (3) is mounted (FIG. 4).

The household appliance (1) furthermore comprises two wires (10, 100) disposed at the backside of the outer panel (8), positioned parallel to each other such that an opening remains there between and both of them partially covering the hole (9), (FIG. 3).

When the handle (3) is to be mounted on the door (2), the head (5) at the end of the pin (4) secured on the handle (3) is inserted in through the hole (9) on the outer panel (8). In this position, the head (5) stretches the wires (10, 100) over the hole (9) and the head (5) passes all the way through the hole (9) reaching to the other side of the outer panel (8). After the head (5) passes to behind the outer panel (8), simultaneously the wires (10, 100) resume their initial position and are seated in the groove (7). In this position, the outer panel (8) is seated on the step (6) and the pin (4), having a diameter greater than the diameter of the hole (9), bears against the front surface of the outer panel (8). The width of the step (6) is virtually equal to the wall thickness of the outer panel (8) and the width of the groove (7) is approximately equal to the diameter of the wire (10, 100). While the step (6) prevents the handle (3) mounted on the outer panel (8) from moving in the vertical plane, whereas the wires (10, 100) seated in the groove (7) take up the assembly gap between the outer panel (8) and the handle (3) thereby preventing the handle (3) from moving both in the vertical and horizontal planes and also maintain the handle (3) to be locked on the outer panel (8). Moreover, by means of the present invention, the handle (3) is mounted on the outer panel (8) without using any intermediary elements.

In another embodiment of the present invention, the household appliance (1) comprises wires (10, 100) made of different diameters from each other and resilient at different rates. In this embodiment of the present invention, while the head (5) passes through the hole (9), the wire (10) with the smaller diameter stretches more than the other wire (100) maintaining the head (5) to pass through the hole (9), the greater diameter wire (100) is seated in the groove (7) without a gap after the head (5) passes and prevents the movement of the handle (3) on the outer panel (8). Consequently, the handle (3) can be easily mounted on the door (2) without using screws or similar fastening elements. In this embodiment, the handle (3) can be dismounted from the door (2) only by using a tool. Moreover, in this embodiment, the handle (3) can be mounted on the door (2) from the front side of the door (2) without the need for a fastening process from the other side of the outer panel (8) (FIG. 5).

In another embodiment of the present invention, the wires (10, 100) are produced of spring steel. In this embodiment of the present invention, the wire (10, 100) can be configured by bending.

In another embodiment of the present invention, the diameter of the wire (100) with the greater diameter equals at least the width of the groove (7). Thus, the wire (100) entirely sits in the groove (7). Since the wire (100) bears against both walls of the second groove (7), the handle (3) is mounted on the door (2) without a gap.

The household appliance (1) can be a dishwasher, an oven or a refrigerator.

By means of the present invention, the handle (3) can be mounted on the door (2) without using any screws. Thus the household appliance (1), after manufacturing, can be transported without a handle (3) until reaching the end user and can be easily mounted on the door (2) when delivered to the end user. This prevents the handle (3) from being damaged during the transportation activities.

The invention claimed is:

1. A household appliance (1) that comprises a door (2) for allowing access of the user inside, an outer panel (8) disposed on the door (2), a handle (3) mounted on the outer panel (8), so that the user can hold to open, close the door (2) and one or more holes (9) on the outer panel (8), in the section wherein the handle (3) is to be mounted and characterized by a pin (4) with a diameter greater than the diameter of the hole (9), one end secured on the handle (3), a step (6) on the end of the pin (4) with a diameter virtually the same as the diameter of the hole (9), whereon the outer panel (8) is seated and a groove (7) situated at the end of the step (6) with a diameter smaller than the diameter of the step (6) and two wires (10, 100) disposed at the backside of the outer panel (8) that are positioned parallel to each other such that an opening remains there between and both of the two wires (10, 100) are partially covering the hole (9) and a head (5) disposed at the end of the pin (4) that passes to the other side of the outer panel (8) by stretching the two wires (10, 100) while the handle (3) is mounted.

2. The household appliance (1) as in claim 1, wherein wires (10, 100) are made of different diameters from each other and resilient at different rates.

3. The household appliance (1) as in claim 1, wherein the pin (4) having a diameter greater than the diameter of the hole (9), and that bears on the front surface of the outer panel (8).

4. The household appliance (1) as in claim 1, wherein the step (6) with a width that is virtually equal to the wall thickness of the outer panel (8).

5. The household appliance (1) as in claim 1, wherein the groove (7) with a width that is virtually equal to the diameter of the wire (10, 100).

6. A household appliance (1) that comprises a door (2) for allowing access of the user inside, an outer panel (8) disposed on the door (2), a handle (3) mounted on the outer panel (8), so that the user can hold to open, close the door (2) and one or more holes (9) on the outer panel (8), in the section wherein the handle (3) is to be mounted and characterized by a pin (4) with a diameter greater than the diameter of the hole (9), one end secured on the handle (3), a step (6) on the end of the pin (4) with a diameter virtually the same as the diameter of the hole (9), whereon the outer panel (8) is seated and a groove (7) situated at the end of the step (6) with a diameter smaller than the diameter of the step (6) and two wires (10, 100) having diameters disposed at the backside of the outer panel (8) that are positioned parallel to each other such that an opening remains there between and both of the two wires (10, 100) are partially covering the hole (9) and a head (5) disposed at the end of the pin (4) that passes to the other side of the outer panel (8) by stretching the two wires (10, 100) while the handle (3) is mounted.

* * * * *